US007520501B2

(12) United States Patent
Lee

(10) Patent No.: US 7,520,501 B2
(45) Date of Patent: Apr. 21, 2009

(54) MEDIA CASSETTE FOR MEDIA DISPENSER

(75) Inventor: Byung-Mok Lee, Suwon (KR)

(73) Assignee: LG N-Sys Inc., Seoul (KR)

( * ) Notice: Subject to any disclaimer, the term of this patent is extended or adjusted under 35 U.S.C. 154(b) by 455 days.

(21) Appl. No.: 10/998,719

(22) Filed: Nov. 30, 2004

(65) Prior Publication Data

US 2005/0140079 A1 Jun. 30, 2005

(30) Foreign Application Priority Data

Dec. 26, 2003 (KR) ..... 10-2003-0097663

(51) Int. Cl.
*B65H 1/02* (2006.01)

(52) U.S. Cl. ..... 271/149

(58) Field of Classification Search ..... 109/47, 109/55; 271/145, 162–164, 149; 221/197, 221/198, 287

See application file for complete search history.

(56) References Cited

U.S. PATENT DOCUMENTS 4,570,548 A * 2/1986 Martin et al. ..... 109/66
5,071,032 A * 12/1991 Thornton et al. ..... 221/154
5,234,209 A 8/1993 Weigel et al.
6,520,375 B2 * 2/2003 Youn ..... 221/197
2003/0047568 A1 * 3/2003 Ko et al. ..... 221/197

FOREIGN PATENT DOCUMENTS

JP 09-185749 7/1997
WO WO-97/31342 A1 8/1997

OTHER PUBLICATIONS

English Abstract of KR 20-0265560.

* cited by examiner

*Primary Examiner*—Patrick H Mackey
*Assistant Examiner*—Jeremy Severson
(74) *Attorney, Agent, or Firm*—Birch, Stewart, Kolasch & Birch, LLP

(57) ABSTRACT

A media cassette for a media dispenser includes a cassette body which includes a storage space in which media are filled and a discharging opening through which the media are discharged. A door selectively opens and closes the discharging opening. A solenoid and locking member are installed in the storage space to selectively lock and unlock the door in response to an external electrical signal. A gear unit is formed at an external surface of the door, and an opening/closing gear of the media dispenser is engaged with the gear unit to open and close the door. The solenoid is installed in the cassette body, and the locking member is also installed in the cassette body to lock and unlock the door via a driving force of the solenoid.

10 Claims, 4 Drawing Sheets

MEDIA CASSETTE FOR MEDIA DISPENSER

This application claims the benefit of Korean Patent Application No. P2003-097663 filed on Dec. 26, 2003, the entire contents of which are herein fully incorporated by reference.

BACKGROUND OF THE INVENTION

1. Field of the Invention

The present invention relates to a media dispenser, and more particularly, to a media cassette for a media dispenser, wherein the media cassette with media filled therein is detachably installed in the media dispenser.

2. Description of the Related Art

FIG. 1 shows a schematic configuration of a related art media dispenser. Referring to this figure, a media cassette 3 is installed at a lower rear end of a media dispenser 1. The media cassette 3 is beforehand filled with media that should be discharged or provided to a customer. In general, the media cassette 3 can be detached from the media dispenser 1.

A media pickup part 5, for separating the media filled in the media cassette 3 sheet by sheet, is provided in the media dispenser 1. The media in the media cassette 3 are separated sheet by sheet and discharged to the outside.

As illustrated in bold lines in FIG. 1, the media which are separated and discharged from the media cassette 3 by means of the media pickup part 5 are sorted and transferred to a discharging part 11 or a reject box 13 through a feed module 7 and a delivery module 9. The discharging part 11 supplies the media from the media cassette 3 to a user. The reject box 13 collects inferior media or the media supplied in a state where a plurality of media are fed together (e.g., a misfeed of two or more stacked media sheets).

However, the aforementioned related art has drawbacks.

To fill the media cassette 3 with media, the media cassette 3 should be detached from the media dispenser 1 and then again mounted into the media dispenser 1. Thus, to prevent the media from being stolen while the media cassette 3 is carried after being detached from the media dispenser 1, a door of the media cassette 3 should be locked generally using an additional locking mechanism.

However, there is a problem in that an operator sometimes gains access to the media cassette 3 while its door is inadvertently unlocked or a person other than the operator intentionally steals the media from the media cassette 3. Also, if a structure for locking the door of the media cassette 3 is installed at the outside of the media cassette 3, there is another problem in that the media stored in the media cassette 3 may be easily stolen by picking or breaking the lock.

SUMMARY OF THE INVENTION

Accordingly, the present invention is conceived to solve one or more of the aforementioned drawbacks in the related art. An object of the present invention is to provide a media cassette in which a structure for locking a door for opening and closing the media cassette is installed.

Another object of the present invention is to provide a media cassette wherein a door is unlocked only by a signal (e.g., electrical or optical), which can be provided by the media dispenser when the media cassette is mounted into the media dispenser.

According to one embodiment of the present invention for achieving one or more of the objects, there is provided a media cassette for a media dispenser, comprising a cassette body that includes a storage space in which media are filled and a discharging opening, at a side thereof, through which the media are discharged. A door selectively opens and closes the discharging opening. A door locking mechanism is installed in the storage space defined in the cassette body to selectively lock and unlock the door in response to an external signal.

In one embodiment, a gear unit is formed at an external surface of the door to receive power for opening and closing the door. An opening/closing gear is engaged with the gear unit for opening and closing the door. The opening/closing gear may be provided at a main body of the media dispenser to which the cassette body is mounted.

The door locking mechanism may include a driving source that is installed in the cassette body, and a locking member that is installed in the cassette body to be selectively hooked into the door by means of a driving force of the driving source.

The driving source may be a solenoid for unlocking the locking member, as external power is supplied thereto.

The locking member may be supported by means of an elastic member, tending to move the locking member to a position in which the door is locked closed. A slide guide may be provided between the driving source and the locking member to generate a lifting and lowering motion of the locking member.

Preferably, inclined portions are provided at corresponding positions on the slide guide and the locking member, respectively, to cooperate with each other.

According to another aspect of the present invention, there is provided a media cassette for a media dispenser, comprising a cassette body that includes a storage space in which media are filled and a discharging opening, at a side thereof, through which the media are discharged. A door is installed at the cassette body to selectively open and close the discharging opening such that both ends of the door can be pivoted on a rotational shaft. A driving means is installed in the cassette body and driven in response to an electrical signal applied from the outside. A locking member is installed in the cassette body. The locking member is biased in a direction tending to lock or hook the door, but can be unhooked from the door by means of the driving means.

Preferably, a gear unit is formed at an external surface of the door to receive power for opening and closing the door. An opening/closing gear of the media dispenser is engaged with the gear unit of the cassette body to open and close the door.

The driving means may be a solenoid for unlocking the locking member as the external power is supplied thereto.

Preferably, a slide guide, which is driven by the driving means for lifting and lowering the locking member, is provided between the driving means and the locking member. Cooperating inclined portions are formed at corresponding positions on the slide guide and the locking member, respectively.

The locking member may be formed with locking portions extending in parallel at opposite ends thereof and spaced apart from each other at a predetermined interval.

According to the media cassette for the media dispenser of the present invention configured as above, since the structure for locking the door used to open and close the media cassette is installed within the media cassette and the door can be unlocked only by the electrical signal produced when the media cassette is mounted into the media dispenser, the media can be prevented from being lost or stolen when the media cassette is removed from the media dispenser.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Hereinafter, preferred embodiments of a media cassette for a media dispenser according to the present invention will be described in detail with reference to the accompanying drawings.

Figure 1:
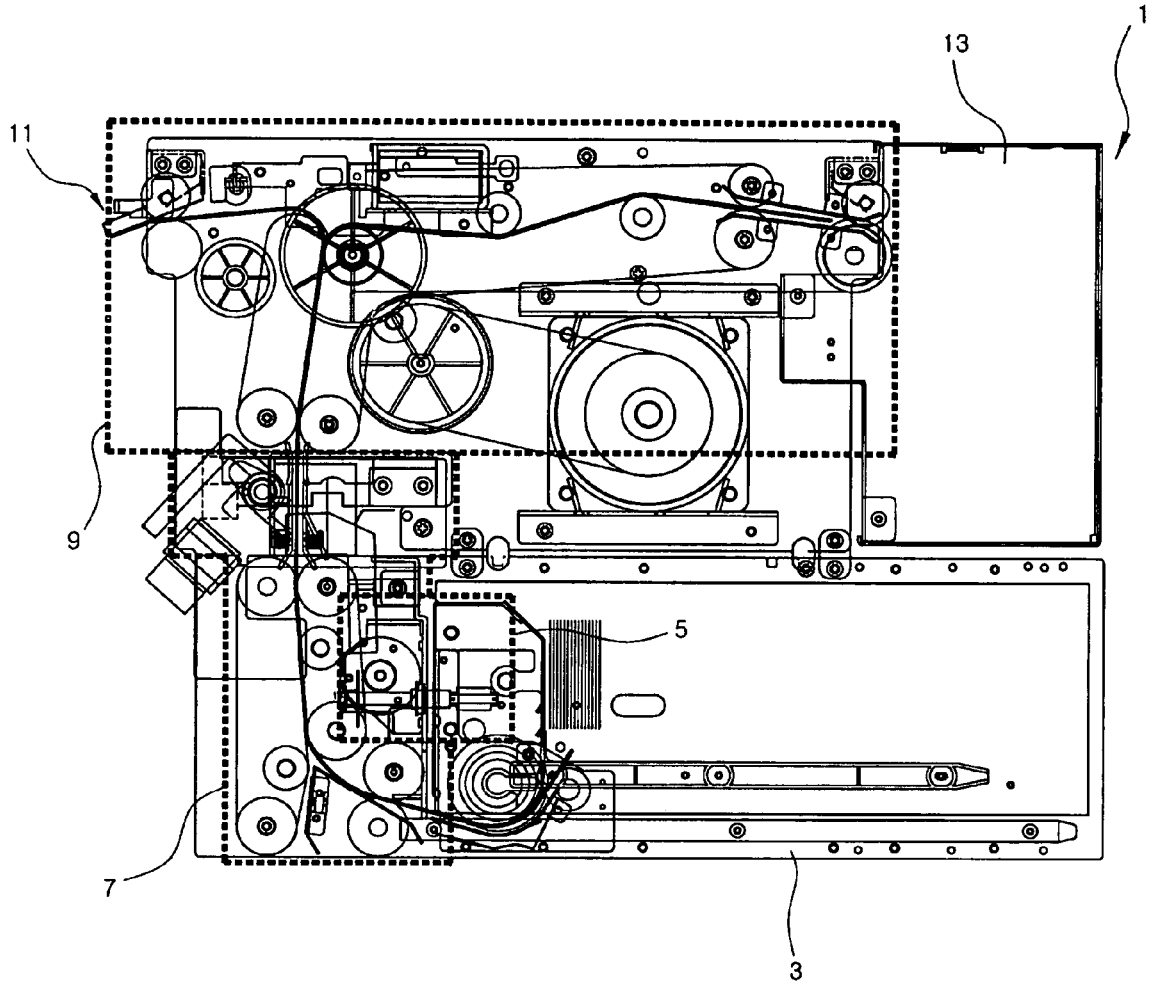
Fig. 1 Related art
FIG. 1 is a view showing the configuration of a related art media dispenser.
Figure 2:
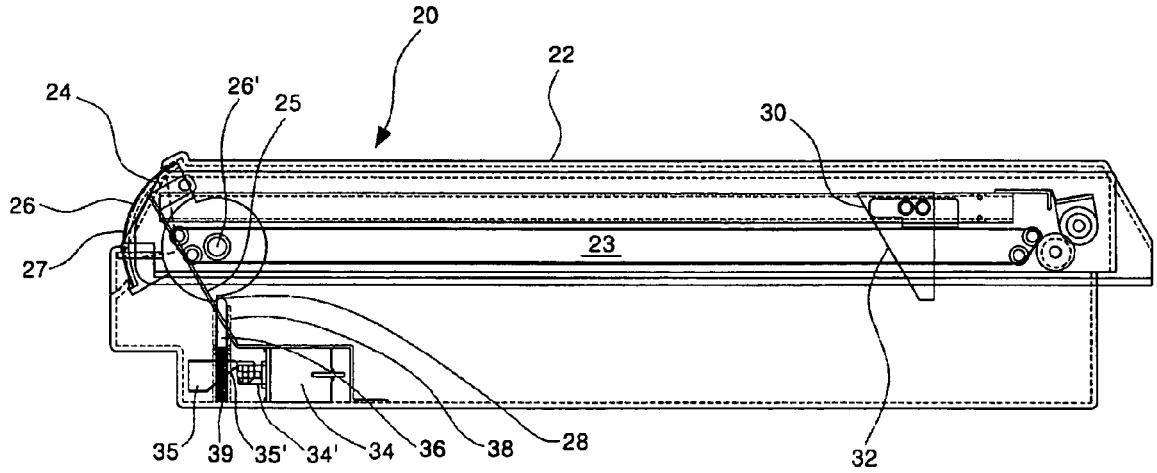
FIG. 2 is a sectional view showing the configuration of a media cassette for a media dispenser, according to an embodiment of the present invention.
Figure 3:
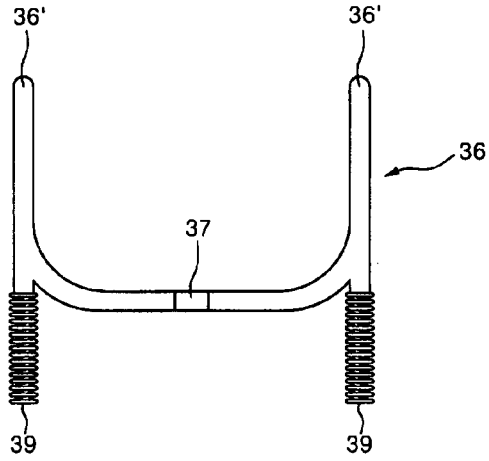
FIG. 3 is a schematic front view showing the configuration of a locking member, used in the present invention.
Figure 4:
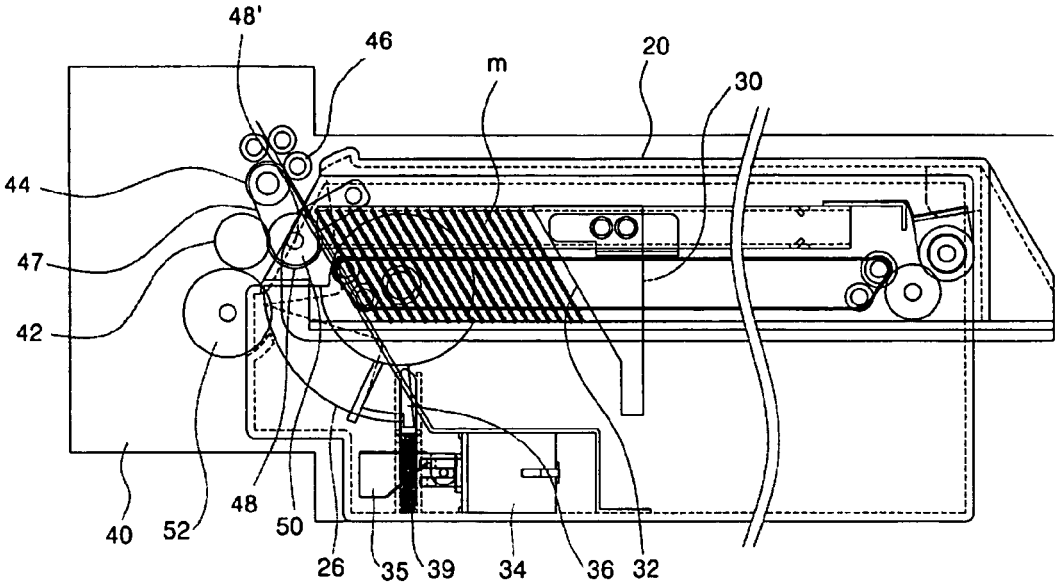
FIG. 4 is a sectional view showing a state where the media cassette, according to the present invention, is mounted into the media dispenser.

FIG. 2 is a sectional view schematically showing the configuration of the media cassette for the media dispenser, according to an embodiment of the present invention, FIG. 3 is a front view schematically showing the configuration of a locking member, used in the present invention, and FIG. 4 is a sectional view schematically showing a state where the media cassette is mounted into the media dispenser.

As shown in these figures, a media cassette 20 is mounted into a media dispenser 40. The media cassette 20 is filled with a large amount of media m, in order to provide the media m sheet by sheet. An external appearance of the media cassette 20 is defined by a cassette body 22. The cassette body 22 is shaped as a rectangular parallelepiped. A storage space 23, with media filled therein, is provided within the cassette body 22.

A discharging opening 24 is provided at a front side of the cassette body 22. The discharging opening 24 is a portion through which the media in the cassette body 22 are discharged to a feeding line or path of the media dispenser 40. A width of the discharging opening 24 is formed to be greater than a width of the media m.

An inclined guide 25 for allowing the media m to be securely seated and guided toward the discharging opening 24 is provided at a position adjacent to the discharging opening 24 within the cassette body 22. The media m are guided by the inclined guide 25 in a state where at least lateral ends thereof are in contact with the inclined guide 25. To this end, the inclined guide 25 is formed at a position(s) corresponding to the lateral ends of the media m within the cassette body 22.

The discharging opening 24 is selectively opened and closed by a door 26. The door 26 is configured either to open the discharging opening 24 when the media cassette 20 is mounted into the media dispenser 40 or to close the discharging opening 24 when the media cassette is not mounted into the media dispenser. That is, the door 26 is installed such that both ends thereof can be pivoted on a central shaft 26' within the cassette body 22. A gear unit 27, which is engaged with an opening/closing gear 52, to be explained later, receives a driving force for opening and closing the door. The gear 52 is formed on a front surface of the door 26. The door 26 should be formed to have a width greater than the width of the media m.

A catching step 28 is formed at a side of the door 26. A locking portion 36' of a locking member 36, to be explained later, engages the catching step 28 such that the door 26 causes the discharging opening 24 to be kept closed. The catching step 28 is formed at one or both sides of the door 28 within the storage space 23.

A push plate 30 is installed within the cassette body 22. The push plate 30 serves to push the media m toward the inclined guide 25 within the storage space 23. The push plate 30 is formed such that a front surface thereof includes an inclined surface 32 having the same inclination as the inclined guide 25.

The push plate 30 is configured to push the media m toward the discharging opening 24 within the storage space 23 using a pushing force supplied by a driving force generated from a spring or an additional driving source. In this embodiment, the driving force generated from the an additional driving source is used as the pushing force.

Now, the configuration for causing the door 26 to be kept closed will be described. A solenoid 34, serving as a driving source, is installed within the cassette body 22. The solenoid 34 receives an electrical signal when the media cassette 20 is mounted into the media dispenser 40. The signal drives the solenoid 34. The solenoid 34 includes a plunger 34' which is driven to move toward and away from the solenoid 34. In this embodiment, the plunger 34' retracts toward the solenoid 34 when it is driven.

A slide guide 35 is connected to the plunger 34' of the solenoid 34. The slide guide 35 is formed with an inclined portion 35' for actuating the locking member 36.

The locking member 36 is lifted or lowered as the solenoid 34 is driven. As shown in FIG. 3, the locking member 36 is generally formed to have a U shape. The locking portions 36' are formed at opposite upper ends of the locking member 36 to selectively engage the catching step 28 of the door 26. For reference, the locking member 36 should be designed such that a distance between the locking portions 36' is greater than the width of the media m discharged through the discharging opening 24 so that the locking portions 36' do not interfere with the traveling media m.

The locking member 36 is formed with another inclined portion 37 cooperating with the inclined portion 35' of the slide guide 35. The inclined portion 37 is formed to be inclined upward toward a rear end of the media cassette 20 as viewed from a front end of the media cassette 20.

The locking member 36 is guided to be lifted or lowered by means of a lifting guide 38 that is provided in the cassette body 22. The locking member 36 is supported at opposite sides thereof by means of springs 39. The springs 39 exert an elastic force on the locking member 36 in a direction in which the locking portions 36' of the locking member 36 engage the catching step 28 of the door 26. The springs 39 are installed within the lifting guide 38 so as to exert the elastic force on the locking member 36.

Next, the configuration for separating and feeding the media m, filled in the storage space 23 of the cassette body 22, will be described. A variety of components used to separate and feed the media m in the storage space 23 of the cassette body 22 are provided at a portion in the media dispenser 40 into which the media cassette 20 is mounted.

A driving motor 42 and a feed roller 44, driven by the driving motor 42, are installed at a side of the media dispenser 40. The feed roller 44 is rotated by receiving power from the driving motor 42, but a mechanism for transmitting the power to the feed roller is omitted in the figures to simplify the illustration. The power transmission between the driving motor 42 and the feed roller 44 may be accomplished by using a gear or belt.

A contra-roller 46 is also installed to pair up with the feed roller 44. The feed roller 44 and the contra-roller 46 are rotated in opposite directions and separate any two stacked sheets of media m from each other when the sheets of media pass between the paired rollers 44 and 46. To this end, the power can be transmitted between the feed roller 44 and the contra-roller 46 by connecting them with each other using a gear or belt.

A pickup roller 48 is provided such that it is connected with the feed roller 44 through a driving belt 47 or equivalent gears to receive power. The pickup roller 48 is provided at a tip end of a separate link (not shown in the figures). The link is pivoted on a rotational center shaft of the feed roller 44, and the pickup roller 48 is installed adjacent the freely rotating end of the link.

For reference, when the media cassette 20 is mounted into the media dispenser 40, the pickup roller 48 is inserted slightly into the cassette body 22 through the discharging opening 24 such that a side surface thereof is placed at a position corresponding or in line with the inclined guide 25.

The pickup roller 48 is installed such that both ends of its rotational center shaft 48' are supported on the end of the link. That is, a pair of links are provided to support both ends of the rotational center shaft 48'. A pressure roller 50 is installed on the shaft 48'. The pressure roller 50 is preferably installed such that it is not rotated about the shaft 48'.

The opening/closing gear 52 is installed at a position corresponding to the door 26 of the media cassette 20 within the media dispenser 40. The opening/closing gear 52 can be rotated by receiving power from an additional driving source separate from the driving motor 42. The opening/closing gear 52 is engaged with the gear unit 27 of the door 26 to open and close the door 26.

Hereinafter, the operation of the media cassette for the media dispenser, according to the present invention configured as above, will be described in detail.

Figure 5A:
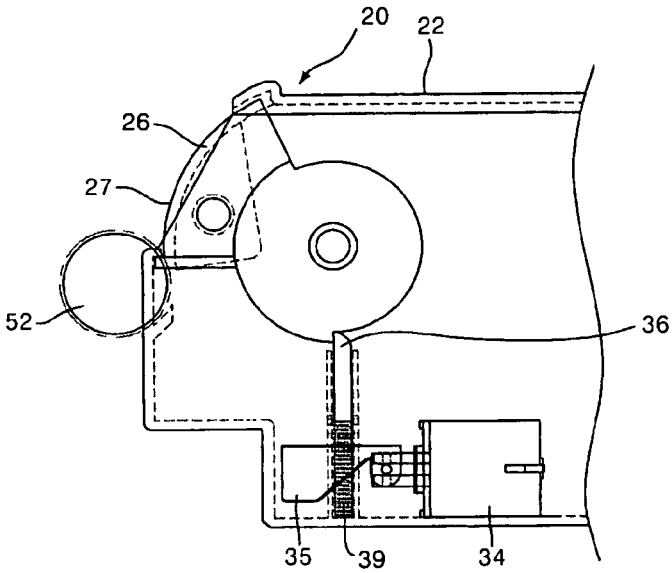
FIG. 5*a* is a sectional view showing a state where a door of the media cassette is closed, according to the present invention.

In the present invention, the media cassette 20 is detachably mounted internally in the media dispenser 40. The media cassette 20, with the media m filled in the storage space 23, is inserted into the media dispenser 40. At this time, as shown in FIG. 5*a*, the door 26 of the media cassette 20 covers the discharging opening 24.

Further, the door 26 cannot be opened because the locking portions 36' of the locking member 36, that moved upward by means of the elastic force of the springs 39, are engaging the catching step 28. That is, the door 26 is in a state where it cannot be rotated about the central shaft 26'.

When the media cassette 20 is mounted into the media dispenser 40, power is supplied to the solenoid 34. Then, the plunger 34' retracts toward the solenoid 34 and thus the slide guide 35 is pulled toward a right direction as viewed in FIG. 5*b*.

Figure 5B:
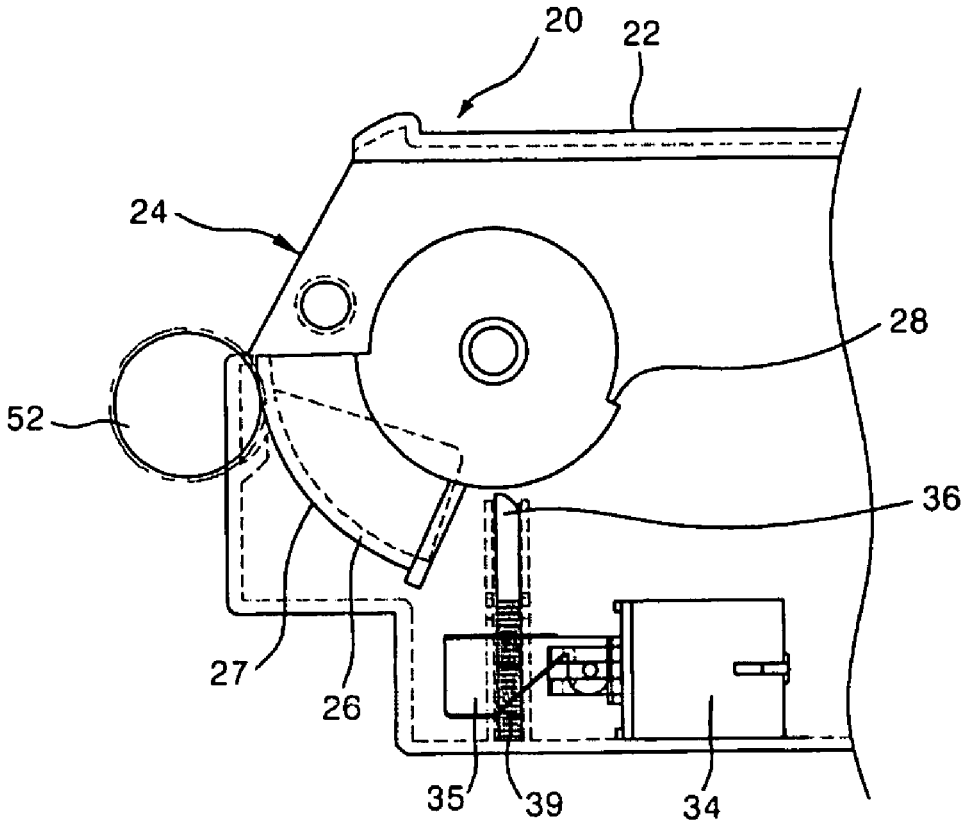
FIG. 5*b* is a sectional view showing a state where the door of the media cassette is open, according to the present invention.

As the slide guide 35 is moved, the locking member 36 moves downward along the lifting guide 38 against the elastic force of the springs 39. This downward movement is performed through the cooperation between the inclined portion 35' of the slide guide 35 and the inclined portion 37 of the locking member 36. Thus, the locking portions 36' of the locking member 36 are moved out from the catching step 28 of the door 26 and the door 26 is then unlocked. A state where the locking portions 36' were moved out form the catching step 28 is shown in FIG. 5*b*.

Thereafter, the opening/closing gear 52 is driven by means of the additional driving source. If the opening/closing gear 52 is driven, power is transmitted to the door 26 through the gear unit 27 engaged with the opening/closing gear 52, and the door 26 is pivoted on the central shaft 26' to open the discharging opening 24. Such a state is shown in FIG. 5*b*. After, or as, the door 26 is opened, power to the solenoid 34 can be removed.

The operation of detaching the media cassette 20 from the media dispenser 40 while the media cassette 20 is being used will be explained. If an electrical signal for detaching the media cassette 20 from the media dispenser 40 is input, the opening/closing gear 52 is driven in a reverse direction and the discharging opening 24 is closed by the door 26.

Then, if the power supplied to the solenoid 34 is shut off, the plunger 34 does not pull the slide guide 35 any longer and the locking member 36 is thus lifted by means of a restoring force of the springs 39. Therefore, the locking portions 36' of the locking member 36 engage or snap into the catching step 28 of the door 26 as the door 26 moves to the fully closed position. Accordingly, the door 26 is locked in a state where the discharging opening 24 is closed, as shown in FIG. 5*a*.

At this time, an operator may detach the media cassette 20 from the media dispenser 40. Once the media cassette 20 is removed, the door 20 is locked and unless the door 20 or cassette body 22 is broken or destroyed, the media m in the storage space 23 defined in the cassette body 22 cannot be taken out.

Furthermore, it is only possible to open the door 26 and remove or fill the media m into the media cassette 20 at a place where the solenoid 34 can be supplied with power. Therefore, the possibility of having the media m in the media cassette 20 stolen is reduced.

According to the present invention as described in detail above, the following advantages can be obtained.

The door of the media cassette cannot be opened unless the solenoid is operated. Since the media cassette can only be opened at a place where an electrical signal for operating the solenoid can be input, it reduces the chance that the media are stolen or lost while the media cassette is carried. The power can be input to the solenoid by attaching a jack on the outside of the media cassette 20, which receives power from a plug attached to the media dispenser 1, when the media cassette 20 is inserted into the media dispenser 1, or into a plug at the bank where the media cassette 20 is opened to fill/remove media therein.

Since all mechanisms for opening and closing the door of the media cassette are installed within the media cassette, there is an advantage in that it is less likely to have the media in the media cassette stolen except when the door or cassette body is broken or destroyed.

The scope of the present invention is not limited by the illustrated embodiments but defined by the appended claims. It will be apparent that those skilled in the art can make various modifications and changes within the scope of the invention defined by the claims. For example, the driving force of the solenoid may be transmitted to the locking member in various manners. For example, the driving force of the solenoid may be transmitted to the locking member via a link mechanism or belt. Furthermore, another driving source may be used instead of a solenoid. That is, any kind of driving source may be employed in the present invention if it can be properly turned on and off.

What is claimed is:

1. A media cassette for a media dispenser, comprising:

a cassette body including a storage space in which media are filled and a discharging opening through which the media are discharged;

a door for selectively opening and closing said discharging opening; and a door locking mechanism for selectively locking and unlocking said door in response to an external electrical signal, wherein said door locking mechanism includes:

a driving source installed in said cassette body; and a locking member installed in said cassette body to selectively engage or disengage a portion of said door in response to a driving force of said driving source, wherein said locking member is supported by an elastic member, and wherein said elastic member tends to move said locking member in a direction which causes said locking member to lock said door closed, wherein said locking member is formed with locking portions spaced apart from each other at a predetermined interval and extending approximately parallel to each other at opposite ends of said locking member, such that said locking member is substantially u-shaped, and wherein said door has first and second ends pivotably connected to said cassette body.

2. The media cassette according to claim 1, wherein said discharging opening is located at a side of said cassette body.

3. The media cassette according to claim 1, wherein said door locking mechanism is installed adjacent said storage space in said cassette body.

4. The media cassette according to claim 1, wherein a gear unit is attached to, or integrally formed on, an external surface of said door, wherein said gear unit is adapted to engage with an opening/closing driven gear of the media dispenser to open and close said door, when said media cassette is mounted to the media dispenser.

5. A media cassette for a media dispenser, comprising:

a cassette body including a storage space in which media are filled and a discharging opening through which the media are discharged;

a door for selectively opening and closing said discharging opening; and a door locking mechanism for selectively locking and unlocking said door in response to an external electrical signal, wherein said door locking mechanism includes:

a driving source installed in said cassette body; and a locking member installed in said cassette body to selectively engage or disengage a portion of said door in response to a driving force of said driving source, wherein said locking member is supported an elastic member, and wherein said elastic member tends to move said locking member in a direction which causes said locking member to lock said door closed, wherein said locking member is formed with locking portions spaced apart from each other at a predetermined interval and extending approximately parallel to each other at opposite ends of said locking member, such that said locking member is substantially u-shaped, wherein said driving source is a solenoid, and wherein said solenoid moves said locking member to disengage said portion of said door when power is supplied to said solenoid.

6. The media cassette according to claim 5, wherein the power supplied to said solenoid is supplied from a source outside of said cassette body.

7. The media cassette according to claim 6, wherein disengaging said portion of said door unlocks said door, such that said door can be opened.

8. A media cassette for a media dispenser, comprising:

a cassette body including a storage spaced in which media are filled and a discharging opening through which the media are discharged;

a door for selectively opening and closing said discharging opening; and a door locking mechanism for selectively locking and unlocking said door in response to an external electrical signal, wherein said door locking mechanism includes:

a driving source installed in said cassette body; and a locking member installed in said cassette body to selectively engage or disengage a portion of said door in response to a driving force of said driving source, wherein said locking member is supported by an elastic member, and wherein said elastic member tends to move said locking member in a direction which causes said locking member to lock said door closed, wherein said locking member is formed with locking portions spaced apart from each other at a predetermined interval and extending approximately parallel to each other at apposite ends of said locking member, such that said locking member is substantially u-shaped, and wherein said predetermined interval is greater than a width of media to be stacked in said storage space of said cassette body.

9. The media cassette according to claim 8, wherein a slide guide is provided between said driving source and said locking member, and wherein said slide guide causes a lifting or lowering motion of said locking member in response to the driving force of said driving source.

10. The media cassette according to claim 9, wherein inclined portions are provided at contacting surfaces of said slide guide and said locking member, respectively, to engage with each other and cause the lifting or lowering of said locking member.

* * * * *